United States Patent [19]

Edwards

[11] 4,273,283

[45] Jun. 16, 1981

[54] AUTOMATIC AIR REGISTER

[76] Inventor: Allen W. Edwards, 405 Hyacinthe Blvd., T.H. 3, Mississauga, Ontario, Canada, L5A 3N1

[21] Appl. No.: 957,545

[22] Filed: Nov. 3, 1978

Related U.S. Application Data

[63] Continuation-in-part of Ser. No. 838,734, Oct. 3, 1977, Pat. No. 4,151,952.

[30] Foreign Application Priority Data

Sep. 16, 1977 [CA] Canada ..... 286878
Feb. 15, 1977 [GB] United Kingdom ..... 6316/77

[51] Int. Cl.[3] ..... F24F 7/00; E05F 15/20

[52] U.S. Cl. ..... 236/49; 49/7; 98/1; 236/101 D; 137/73

[58] Field of Search ..... 98/1, 8 G, 40 VT; 236/49, 101 D, 93 R; 137/73; 49/7

[56] References Cited

U.S. PATENT DOCUMENTS

| | | | |
|---|---|---|---|
| 3,312,159 | 4/1967 | Shepherd | 98/1 |
| 3,836,073 | 9/1974 | Evans et al. | 98/40 VT |
| 4,080,978 | 3/1978 | McCaabe | 236/49 X |

*Primary Examiner*—William E. Wayner

*Attorney, Agent, or Firm*—Sim & McBurney

[57] ABSTRACT

There is provided a self-regulating air register which includes a housing, louvres in the housing for closing and opening a flow path for air, a crank arm connected to the louvres which can, upon rotation, adjust the degree of closure, a shaft extending through the housing means, and a bi-metallic element connected at one end to the shaft and to a control knob at the other end. The control knob is mounted on the housing and is capable of selective adjustment in terms of angle. The bi-metallic element is thus adapted to regulate the angular orientation of the shaft with respect to the housing means, with an additional adjustment by the control knob. A lever is mounted on the shaft and extends perpendicularly from it. In the lever is a slot in which part of the crank arm is captive. At least part of the slot includes a portion disposed such that when part of the crank arm is located in the portion, the crank arm is caused to rotate as the lever rotates. On the control knob is at least one projection which extends perpendicularly through the plane of rotation of the lever but is located to one side thereof, whereby rotation of the control knob in one sense can bring the projection into contact with the lever and thus retain the lever in a position for which the louvre means is in an extreme condition.

11 Claims, 4 Drawing Figures

AUTOMATIC AIR REGISTER

This is a continuation-in-part application of U.S. application Ser. No. 838,734, now U.S. Pat. No. 4,151,952, filed Oct. 3, 1977 entitled AUTOMATIC AIR REGISTER invented by Allen W. Edwards.

The principal application relates to automatic air registers for air conditioning and heating systems in buildings, and discloses specifically an automatic air register designed to thermostatically regulate the amount of air, either hot or cold, forced or convective, which is passing through it.

The principal application provides a self-regulating air register comprising: housing means defining a flow path for air from an air duct, louvre means in the housing means for closing and opening said flow path, a crank arm connected to said louvre means and adapted upon rotation to adjust the louvre means, a shaft mounted for rotation with respect to said housing means, a bi-metallic, temperature-sensitive element connected to said shaft and mounted with respect to the housing means such that it can regulate the angular orientation of the shaft with respect to the housing means, and a lever connected to said shaft and disposed perpendicular thereto, the lever having a slot in which part of said crank arm is captive, the slot including at least one portion disposed such that when the part of the crank arm is located therein, the crank arm is caused to rotate when the lever rotates.

The present application discloses an improvement over the inventive combination just defined, which allows the user of the automatic air register to lock the louvre means in the closed position or in the open position, depending upon how the lock means is constructed, or in an alternative embodiment the user is allowed to lock the louvre means in either of its extreme positions. A further modification disclosed in this application pertains to a safety feature, in which the automatic air register is allowed to close fully upon being subjected to a particular temperature which may be in the area of 300° F. This automatic closure would take place whether or not the stop means had been set to retain the louvre means in an open position. It will be appreciated that the closure of the louvre means during a fire will stop or at least delay the passage of smoke and fire through the register opening from one portion of a burning building to another, thereby giving additional time for the occupants of the building to escape, and presenting the authorities with an opportunity to contain the fire and prevent propagation.

An understanding of the construction and features of the air register defined in the principal application is essential before the improvements which this disclosure provides can be fully understood.

Specifically, in accordance with the invention set forth and claimed in this application, the housing means defined earlier while describing the subject of the principal application supports a pivotal but stiffly mounted adjustable member adjacent the lever, the adjustable member having a projection extending through the plane rotation of the lever and being located to one side thereof, whereby rotation of the adjustable member in one sense can bring the projection into contact with the lever and thus retain the lever in a position for which the louvre means is in an extreme condition.

In a preferred form of the invention, two projections are provided, one on either side of the lever, whereby rotation of the adjustable member in the appropriate sense can cause locking of the lever in either of its extreme conditions.

By providing the projection as a separate piece which is bound to the adjustable member by a binder means which becomes ineffective when raised to a given temperature, this temperature corresponding to flame or excessive heat temperature, the projection will be unable to retain the louvre means in the fully open position against the urging of the bi-metallic temperature sensitive element, and the latter will then be able to rotate the shaft and lever in the sense which causes the louvre means to move toward the closed position. Typically, the binder means would be solder having a fusion temperature between 250° and 350° F.

One embodiment of this invention is shown in the accompanying drawings, in which like numerals denote like parts throughout the several views, and in which.

Figure 1:
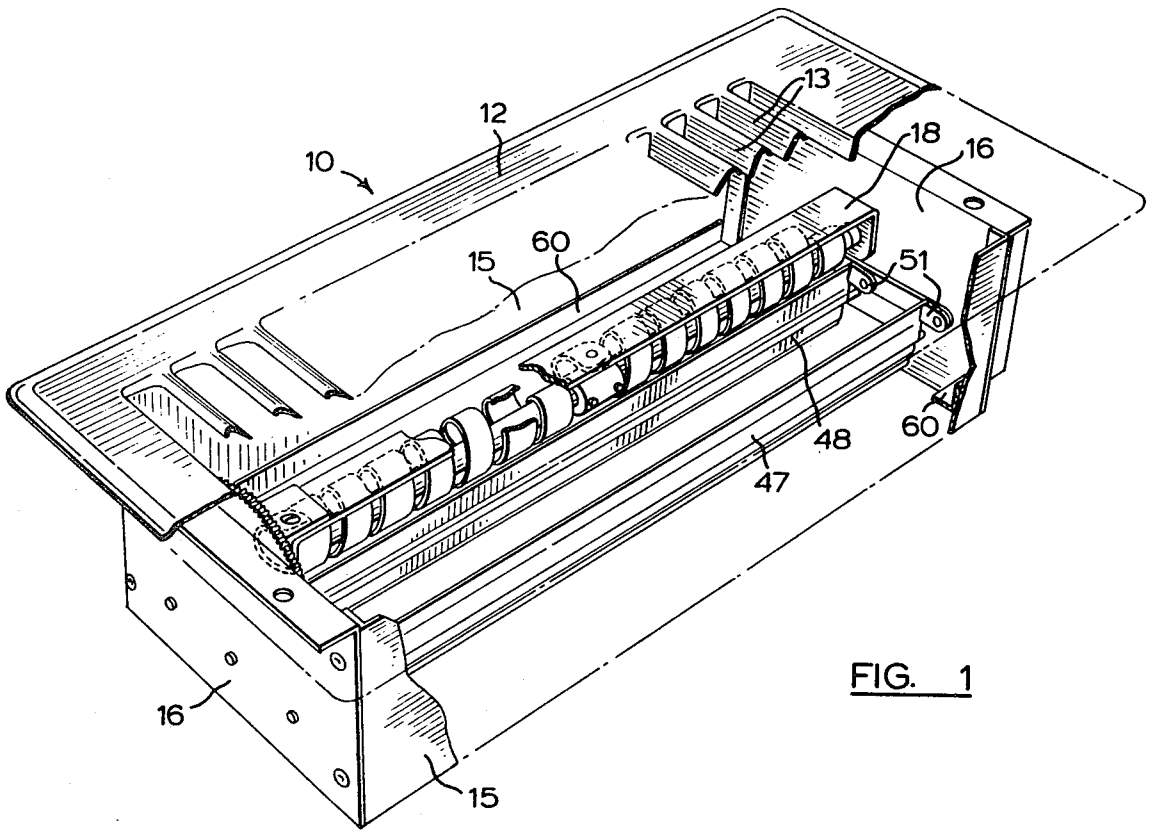
FIG. 1 is a perspective view of the automatic air register disclosed in the principal application, partly broken away.

Referring first to FIG. 1, the air register shown generally at 10 is seen to consist of a top panel 12 having louvres 13 of conventional construction. A main housing of the air register consists of two vertical side walls 15 and two vertical end walls 16.

Figure 2:
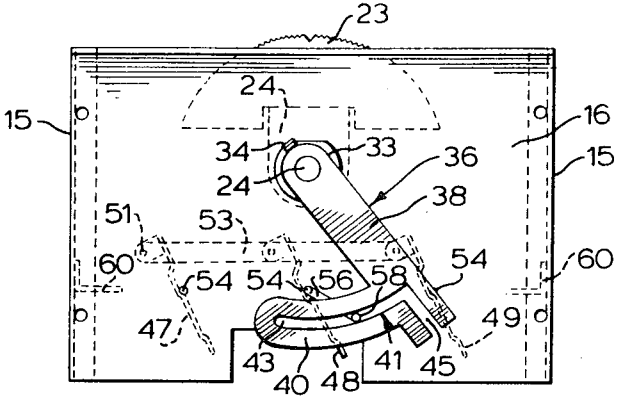
FIG. 2 is an end view of the automatic air register of FIG. 1.
Figure 3:
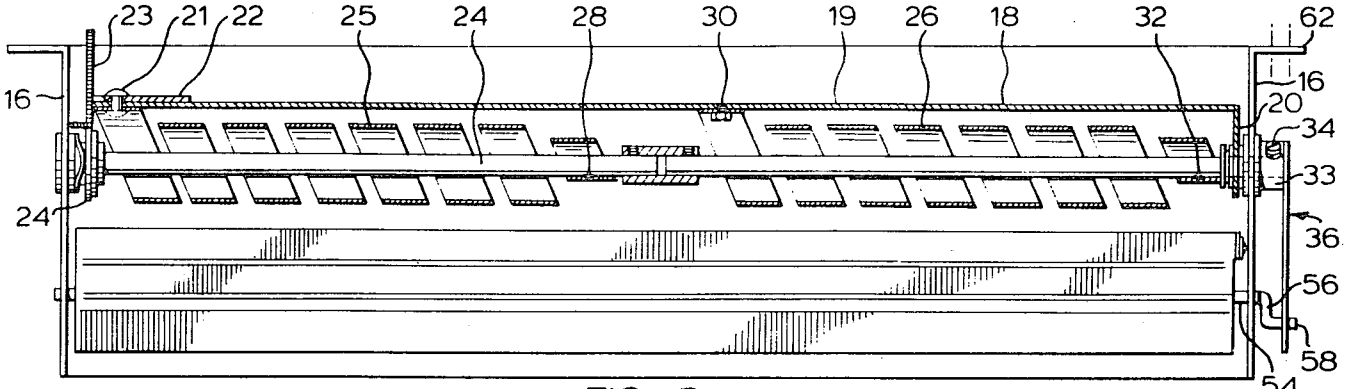
FIG. 3 is an elevational view, partly broken away, of the automatic air register of FIG. 1.

Referring now to all figures, it will be seen firstly that an elongated bracket member 18 is provided centrally and longitudinally of the housing, and that it consists of a longitudinal portion 19 and a downwardly extending vertical end portion 20 at the rightward end as seen in FIG. 3. The leftward end of the bracket member 18 is secured by a rivet 21 to a plate member 22 extending horizontally inwardly from a control knob 23. The control knob 23 is in the shape of a sector of a circle and has a projecting portion 24 which extends to and beyond the location of the centre of curvature of the arcuate sector as can be seen in FIG. 2. The control knob 23 is mounted for rotation about a shaft **24*a* extending the length of the housing and journaled in each of the end walls 16. Thus, digital rotation of the control knob 23 causes the entire bracket member 18 to rotate with the knob 23**.

Mounted around the shaft **24*a* are two helical bimetallic temperature-sensitive elements 25 and 26. The element 25 has its leftward end secured to the bracket member 18 by virtue of the rivet 21, and has its rightward end secured to the shaft 24*a* by spot welding at 28. The element 26 has its leftward end secured to the bracket member 18 by a threaded fastener 30, and has its rightward end secured to the shaft 24*a* by spot welding at 32**.

The shaft **24*a* extends rightwardly through the rightward end wall 16, and to it is affixed a boss 33 having a threaded securement member 34 to allow it to be adjustably affixed with respect to the shaft 24*a*. Fixed with respect to the boss 33 is a lever 36 which includes a first portion 38 extending radially away from the shaft 24*a*, and a second portion 40 which is arcuate and has its centre of curvature substantially aligned with the axis of the shaft 24*a***.

The lever is shaped to define a slot 44 of which a first portion 43 is arcuate and concentric with the axis of the shaft 24*a*, and of which a second portion 45 is substantially radially disposed with respect to the axis of the shaft 24*a*.

Disposed within the housing below the level of the bracket member 18 and the helical bi-metallic elements 25 and 26, are three louvre blades 47, 48 and 49. The louvre blades are all mounted on axes parallel with the axis of the shaft 24*a*, and they are adapted to rotate in tandem. To permit this, each louvre blade includes a perpendicular bracket 51 (see FIG. 1) and a connecting link 53 joins the louvre blades 47–49 together. Elongated pins 54 are affixed to the louvres 47–49 and extend throughout the length of the housing, projecting through the end walls 16. The projecting portions of the pin 54 provide rotational mountings about which the louvre blades can freely swivel.

Looking now at FIG. 3, the rightward end of the pin 54 attached to the middle louvre blade 48 is bent to define a crank arm 56 of which an end part 58 is bent to be parallel with the main extent of the pin, the end part 58 being adapted for capture within the slot 41.

It will be noted particularly in FIG. 2 that the length of the crank arm 56 measured in a direction perpendicular to the main extent of the respective pin (i.e. the actual dimension as seen in end view in FIG. 2) is greater than the distance, measured on a line extending radially from the axis of the shaft 24*a*, between the central pin 54 and the centre line of the first portion 43 of the slot 41. Because the first portion 43 of the slot 41 is arcuate and concentric with the axis of the shaft 24*a*, this means that rotation of the shaft 24*a* and the cover 36 affixed thereto will not cause the crank arm 56 to deviate from the position shown in FIG. 2. This will be the case so long as the end part 58 remains in the first portion 43 of the slot 41.

Assume now that the lever 36 is rotating in the clockwise direction as seen in FIG. 2. Eventually, the rightward end of the first portion 43 of the slot 41 will arrive at the end part 58 of the crank arm 56, at which point the end part 58 will become lodged in the second portion 45 of the slot 41. This will cause the crank arm 56 to begin rotation in the clockwise sense, which in turn will rotate the louvre blades 47–49 also in the clockwise sense. If this clockwise rotation of the louvre blades 47–49 continues far enough, they will eventually extend in overlapping relation across the housing between the side walls 15, thereby blocking air flow through the housing. Each side wall 15 has affixed thereto an elongated angle bracket 60 against which the extreme lateral portions of the outside louvre blades 47 and 49 may rest to complete the seal.

In some cases it may be desirable to provide a by-pass opening to allow a small bleed-through of air past the housing when it is closed off by the louvre blades 47–49, and such an opening (or openings) can be provided in flange portions 62 at the top of the end wall 16, in angle brackets 60, or in other suitable locations.

It will be appreciated that the second portion 45 of the slot 41 also permits easy disassembly of the device, since it opens downwardly to allow the end part 58 of the crank arm 56 to be removed.

It will now be understood that thermostatic control of the space heated by air passing through the automatic air register 10 shown in the drawings is achieved due to the function of the bi-metallic elements 25 and 26, and the possibility of adjusting that function by using the control knob 23. The bi-metallic elements respond to a change of temperature of the air passing through the register, and the actuation of the mechanical linkage involving the lever 36 is adapted to open or close the louvre blades 47–49.

The configuration of the various portions shown in FIG. 2 is one which will achieve rotation of the louvre blades 47–49 from the fully open to the fully closed position (i.e. slightly over 90° rotation for the louvre blades) while requiring an angular movement of only 15° or 20° on the part of the lever 36. The particular temperature at which this range of 15°–20° is undergone by the lever 36 is of course selected by rotating the control knob 23 to a desired position.

In operation, it is assumed first that the hot air furnace which is adapted to heat the air is off due to the fact that a main thermostat located in the building is not calling for heat. This will allow air in the region of the bi-metallic elements 25 and 26 to cool down to room temperature, either because air is still being forced by the fan but not heated, or because the fan is also off and the air in the ducts is stagnant. In this condition, with the bi-metallic elements 25 and 26 at normal room temperature, the lever 36 will have swung to the maximum distance in the counterclockwise sense as seen in FIG. 2, and this will require the louvre blades 47–49 to assume the position in which they have been drawn in FIG. 2 (in broken lines). In this position they are only slightly off the vertical, and the air register can be considered to be completely "open".

As soon as the furnace begins to heat air to force the heated air through the automatic air register, the bi-metallic elements 25 and 26 will begin to warm up. There is, however, a lag-time before the bi-metallic elements heat to the point necessary to swing the lever 36 far enough in the clockwise sense to bring the end part 58 of the crank arm 56 into contact with the second portion 45 of the slot 41. This lag-time allows the space served by the automatic air register to heat quickly and to attain the desired temperature for that particular space, before the louvre blades 47–49 partly or fully close to reduce the air flow through the automatic air register to the flow volume necessary merely to maintain the space at the temperature which has now been attained. The position of the louvre blades 47–49 at this higher room temperature, with heated air passing through the air register and with the bi-metallic elements 25 and 26 at the same temperature as the hot air, can be adjusted by means of the control knob 23.

The register may be applied in many situations. Obvious applications are residential-commercial forced air or radiant heating systems, and air conditioning systems. Other suitable applications could involve computers and business machines where ventilation or air flow control is necessary, production machinery where the control of air flow is required, and any and all air control systems where an inexpensive means of controlling air flow would be of advantage.

It is expected that use of the air register disclosed herein will result in conserving substantial quantities of fuel, since inadvertent over-heating of a space through allowing a normal register to remain too widely open for the heating cycle, which is very wasteful of energy, is avoided.

In regard to the residential-commercial forced air heating system application for this invention, it is not a normal practice to install a furnace control thermostat in each individual room of a house, and therefore it is almost impossible to maintain uniform temperature environment in all rooms. The room where the furnace control thermostat is located is usually the only room with a controlled temperature environment. Frequently a system utilizing one control thermostat results in "cold" rooms or "hot" rooms in other parts of the building, due to exposure, location, heating duct configuration, and other causes. In order to heat a "cold" room, it is typical practice to set the single thermostat control for the building to a higher level, but of course this raises the temperature in other rooms which are normally at a higher level. In order to compensate for this difficult situation, standard heat registers normally installed have mechanical baffle arrangements which will control the flow or air from 0% to 100%. However, this adjustment is a static adjustment and is fully manual. If the problem of a "hot" room exists, the register in the room could be manually adjusted to restrict the flow of air passing through it, but this could well result in the same room becoming a "cold" space because the adjustment once made is static.

The automatic air register disclosed herein is not intended to maintain a constant uniform temperature in a given room. Its prime objective is to provide an automatic control which will permit the unrestricted flow of heated air passing through the register in the shortest possible time upon start up of the furnace, resulting in a shorter period for the warming up of the space involved. As the temperature of the air passing through the register increases, the temperature-sensitive elements located in the register will bring the mechanical linkage into operation and will gradually restrict the volume of air passing through the register to a particular percentage of full flow, depending upon the control setting. This will of course allow a greater portion of the available air to be diverted to other channels in the heating system.

There are several additional advantages of the automatic air register disclosed herein.

Firstly, a more equitable and efficient automatic distribution of heated air in the system will result in less fuel consumption per furnace air, and a reduced electrical energy requirement due to a shorter furnace operating cycle.

Secondly, the individual room automatic registers will automatically divert heated air back into the system according to their control setting, which will in turn decrease the average warm up time of other difficult-to-heat rooms since a greater volume of heated air will be available to them. This in turn will reduce the average furnace operating cycle time, and the maintenance requirements of the system. Extended air filter life is also expected to be attained.

Finally, once a suitable control setting has been selected for a given air register, the same will thermostatically and automatically operate, requiring a minimum of further adjustments. This will thus provide a supplemental support system in conjunction with the furnace control thermostat.

In terms of the register itself, it will be appreciated that no maintenance is necessary for the automatic air register, aside from a periodic cleaning, which could be carried out by rinsing in hot water. Secondly, no electrical or mechanical services are required, and the unit can be installed in a matter of seconds. The mounting position is not a limitation, since horizontal, vertical or upside-down mounting would not interfere with operation. And of course, the unit can also be fitted into older systems by replacing the manual, static registers.

Since no electrical or mechanical system is involved which interlinks the air registers together or with a previous system, the cost of installation for a completely automated thermostatic control system for individually controlling separate spaces within a single building would be relatively low.

It is considered that the air register provided herein will bridge the gap between the main furnace thermostatic control and the point at which controlled air is released into the environment, namely at the register. It provides a complementary control support function automatically, while also fulfilling the basic function of a register.

In place of the elements 25 and 26 described above and shown in the drawings, it is possible to substitute any of the following:

a. A spiral bi-metal coil.
b. A flat bi-metal strip.
c. A cantilever bi-metal.
d. A symmetrical or non-symmetrical "U" shape bi-metal.
e. A wire bi-metal.
f. An "L" shaped bi-metal.
g. A trapezoidal beam bi-metal.
h. A disc bi-metal.
i. A combination spiral helix bi-metal.

It would also be possible to control individual or groups of baffles with one or more bi-metal shape each, or a combination of shapes. Furthermore, one could dispense with baffles and use a suitably shaped bi-metal component by itself to control the air flow. In other words, the bi-metal components would be in place of the baffles, and its angulation or curvature upon temperature change would suffice to change the air flow through the register. It should also be pointed out that it would be possible to use an auxiliary heater in conjunction with a bi-metal shape in order to establish a system of calibration control.

Figure 4:
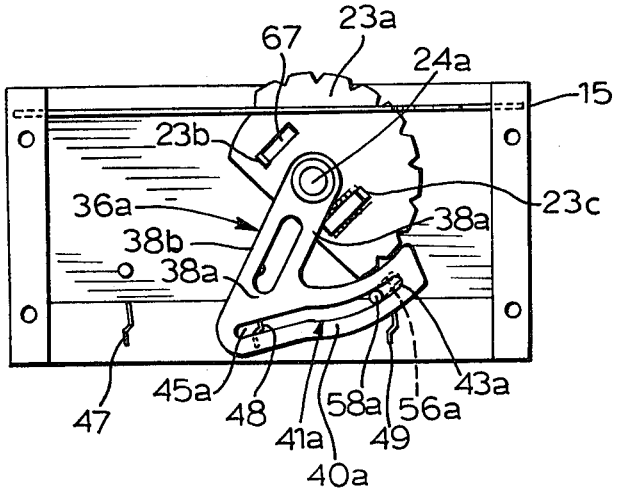
FIG. 4 is an end view of a modification of the air register, showing the improvements to which this application is specifically directed.

FIG. 4 shows the modifications and improvements provided by the present application, and reference should be had to this figure for the following description.

FIG. 4 is an end view quite similar to that of FIG. 2, but certain of the parts are redesigned. It is firstly to be understood that, within the housing 15, there is again provided a shaft 24*a*, bi-metallic temperature-sensitive elements 25 and 26 are louvres 47, 48 and 49. A crank arm 56*a* is provided, functioning in the same manner as crank arm 56 shown in FIG. 2, but the crank arm is attached to the far right louvre 49 at the axis of the same, rather than to the middle louvre 48 as seen in FIG. 2. The lever 36*a* shown in FIG. 4 is of a slightly different construction from that shown at 36 in FIG. 2, although it functions in the same manner. The lever 36*a* includes a radial portion 38*a* and an arcuate portion 40*a*. Provided in the arcuate portion 40*a* is a slot in which the end part 58*a* of the crank arm 56*a* is captive. The slot is numbered 41*a* and has a first portion 43*a* which is arcuate and concentric with the axis of the shaft 24*a*, and another portion 45*a* which is obliquely disposed to a radiant from the axis of the shaft 24*a*, such that when the lever 36*a* swings around in the counter-clockwise sense from the position shown in FIG. 4, the entry of the part 58*a* of the crank 56*a* into the portion 45*a* of the slot 41*a* will cause the crank arm 56*a* to begin to rotate in the counter-clockwise sense as seen in FIG. 4, thus causing the louvres 47, 48 and 49 to move toward their closed positions.

In the modification shown in FIG. 4, there is provided an adjustable member 23*a* corresponding to, but not identical to, the adjustable member 23 shown in FIG. 2. The adjustable member 23*a* is again mounted to be somewhat stiff but pivotal about the centre axis of the shaft 24*a*, such that the adjustable member 23*a* can take up any number of angular positions and will remain in any position it is given. The adjustable member 23*a* supports a first projection 23*b* and a second projection 23*c*, these projections extending toward the viewer when looking at FIG. 4, i.e. perpendicular to the plane of the drawing paper in FIG. 4, to a sufficient extent that they extend through the plane of rotation of the lever 36*a*. It will be seen in FIG. 4 that the adjustable member 23*a* is located on the far side of the lever 36*a*. The construction is such that the adjustable member 23*a* is relatively closely adjacent the lever 36*a*, so that the projections 23*b* and 23*c* do not have to extend an inordinate distance. The projection 23*b* may be in the form of a simple tongue which is stamped out of the adjustable member 23*a*, and it will be seen in FIG. 4 that the portion of the housing behind the adjustable member 23*a* is visible through the "window" 67 arising from the stamping operation. The other projection 23*c* may also be stamped out in one form of the modification provided in this application, where fire protection is not considered essential, and where it is merely desired to allow the user to lock the lever 36*a* and thus the louvres 47, 48 and 49 in one or other of their extreme positions. Thus, in FIG. 4 the rectangle adjacent the projection 23*c* could represent the "window" arising from the stamping operation.

It will be appreciated that the projections 23*b* or 23*c* come into contact with the elongated side edges of the portion 38*a* of the lever 36*a*, thus preventing movement of the lever 36*a* in one direction or the other until the adjustable member 23*a* is moved away from the position in question.

If it is desired to allow for the possibility of complete closure of the louvres 47, 48 and 49 upon the air in the vicinity of the register reaching a certain predetermined temperature corresponding to flame or fire, for example around 300° F., then instead of making the projection 23*c* as a stamped out tongue on the adjustable member 23*a*, the projection 23*c* could be provided in the form of an L-shaped bracket having a projecting portion identified as 23*c*, and having a flange portion which may be considered to be defined by the rectangle adjacent the projection 23*c* in FIG. 4, which flange portion is secured to the adjustable member 23*a* by some binder means which becomes ineffective as a binder when raised to the preselected temperature above normal room temperature. For example, the binder could be a eutectic solder composed lead and tin, having a melting point in the vicinity of 300° F. Thus, when flame or excessive heat would be found in the vicinity of the air register, and should the adjustable member 23*a* at that particular time be adjusted to its furthest clockwise position in which the projection 23*c* is against the right-hand edge of the portion 38*a* of the lever 36*a*, thus preventing counter-clockwise movement of the lever in order to close the louvres, despite the fact that the bi-metallic means would be attempting to urge the lever in that direction, then the melting of the solder or other equivalent binder holding the projection 23*c* on the adjustable member 23*a* will allow the bi-metallic means to rapidly move the lever 36*a* in the clockwise sense thus in effect "slamming" the louvres 47, 48 and 49 shut, thereby inhibiting the passage of the hot, flame- or smoke-filled air through the register.

Thus, the operation of the device in fire conditions would be as follows. Supposing that there is a fire in the proximity of the air register, and the air register has been adjusted by the operator in order to keep the louvres 47, 48 and 49 in the fully open or partially open condition, the following events take place. As the temperature rises, the bi-metallic means will attempt to rotate the lever 36*a* in the counter-clockwise sense, but will be unable to do so due to the projection 23*c* on the adjustable member 23*a*. Since the lever 36*a* cannot rotate, the bi-metallic elements will build up a substantial torque or potential energy. When the ambient temperature reaches approximately 300° F., the eutectic solder material will melt, thus breaking the fusable bond between the adjustable member and the projection 23*c*. When this happens, the energy stored by the bi-metallic coils due to the high temperature will be suddenly released, and will rotate the lever 36*a* counter-clockwise with a considerable force, pushing the now ineffective projection 23*c* out of the way, and slamming the louvres 47, 48 and 49 into the closed position, regardless of the original setting of the adjustable member 23*a*. The other projection, designated as 23*b* in FIG. 4, is a lock projection which contacts the leftward edge of the part 38*a* of the lever 36*a*, and is adapted to lock the lever 36*a* into its fully counter-clockwise position, thus retaining the louvres 47, 48 and 49 in their fully closed position. The automatic register will remain in this status until the operator manually changes the setting of the adjustable member 23*a*.

What I claim is:

1. An air register comprising:

housing means defining a flow path for air from an air duct, louvre means in the housing means for closing and opening said flow path, a crank arm connected to said louvre means and adapted upon rotation to adjust the louvre means, a shaft mounted for rotation with respect to said housing means, a bi-metallic, temperature-sensitive element connected to said shaft and mounted with respect to the housing means such that it can regulate the angular orientation of the shaft with respect to the housing means, and a lever connected to said shaft and disposed perpendicular thereto, the lever having a slot in which part of said crank arm is captive, the slot including at least one portion disposed such that when said part of the crank arm is located therein the crank arm is caused to rotate when the lever rotates, said housing means supporting a pivotal but stiffly mounted adjustable member adjacent said lever, the adjustable member having a projection extending through the plane of rotation of the lever and being located to one side thereof, whereby rotation of the adjustable member in one sense can bring the projection into contact with the lever and thus retain the lever in a position for which the louvre means is in an extreme condition.

2. The invention claimed in claim 1, in which said position is that corresponding to fully open louvre means.

3. The invention claimed in claim 1, in which there is a further projection on said adjustable member located generally to the other side of the lever, whereby rotation of the adjustable member in the opposite sense can bring said further projection into contact with the lever and thus retain the lever in a further position in which the louvre means is in the opposite extreme condition.

4. The invention claimed in claim 3, in which said first-mentioned extreme condition is fully open, and said opposite extreme condition is fully closed.

5. The invention claimed in claim 2, in which said projection is secured to the adjustable member by binder means which becomes ineffective as a binder when raised to a given temperature above normal room temperature, whereby when flame or excessive heat is in the vicinity of the air register, the projection will be unable to retain the louvre means in the fully open position, the bi-metallic temperature-sensitive element being connected such that on an increase of heat, it rotates the shaft and the lever in the sense which causes the louvre means to move toward the closed position.

6. The invention claimed in claim 5, in which said binder means is solder and said given temperature is between 250° F. and 350° F.

7. The invention claimed in claim 1, claim 4 or claim 5, in which said one portion of the slot is obliquely disposed to a radiant from the axis of the shaft, and in which the slot has a further portion which is arcuate and concentric with the axis of said shaft.

8. The invention claimed in claim 1, claim 4 or claim 5, in which the louvre means includes a plurality of louvre blades mounted to rotate in tandem about axes parallel with the axis of said shaft, the crank arm being attached to one louvre blade and rotating therewith, said part of the crank arm being spaced from the rotational axis of the louvre blade to which the crank arm is attached.

9. The invention claimed in claim 7, in which the crank arm, when said end part is located in the first portion of the slot, maintains substantially a single oblique orientation with respect to a radial line from the shaft axis.

10. The invention claimed in claim 1, claim 4 or claim 5, in which the said element includes at least one helically configured bi-metallic strip of which one end is affixed to said shaft, and of which the other end is connected to said adjustment member, the latter being capable of assuming selected orientations with respect to the housing means whereby the said other end of the bi-metallic strip is adjustable in orientation.

11. An air register comprising:

housing means defining a flow path for air from an air duct, louvre means in the housing means for closing and opening said flow path, a spring-like element connected to said housing, and means between said element and the louvre means by which the spring-like element can urge said louvre means closed, the spring-like element being a bi-metallic, temperature-sensitive helical coil, stop means capable of restraining the louvre means from closing under the urging of said spring-like element, the stop means being retained in position by means which becomes ineffective to retain it when raised to a given temperature above normal room temperature, said given temperature being between 250° F. and 350° F.

* * * * *